United States Patent [19]

Miettinen

[11] Patent Number: 4,922,578

[45] Date of Patent: May 8, 1990

[54] SHOE SOLE CLEANER

[75] Inventor: Veli V. A. Miettinen, Pielavesi, Finland

[73] Assignee: Finkomat Oy, Nivala, Finland

[21] Appl. No.: 249,567

[22] PCT Filed: Apr. 1, 1986

[86] PCT No.: PCT/FI86/00035

§ 371 Date: Sep. 22, 1988

§ 102(e) Date: Sep. 22, 1988

[87] PCT Pub. No.: WO87/05788

PCT Pub. Date: Oct. 8, 1987

[51] Int. Cl.[5] ..... A47L 23/26

[52] U.S. Cl. ..... 15/36; 15/37

[58] Field of Search ..... 15/36, 37, 97 A, 310, 15/311

[56] References Cited

U.S. PATENT DOCUMENTS 1,277,834 9/1918 Berdar .
2,647,271 8/1953 Ryzenga .
2,860,366 11/1958 Kemp .
2,895,159 7/1959 Ostrow .
3,228,052 1/1966 Kuz .
4,313,238 2/1982 Harbin .

FOREIGN PATENT DOCUMENTS 613979 12/1926 France .
2452909 10/1980 France .

*Primary Examiner*—Edward L. Roberts
*Attorney, Agent, or Firm*—Merchant, Gould, Smith, Edell, Welter & Schmidt

[57] ABSTRACT

The present invention relates to shoe sole cleaner 1 comprising a power section 2 and a brush section 3. The brush section is essentially planelike and it includes brush rods. The power section and the brush section are placed at a distance from each other. The power section is provided with a fluid power supply. The brush section includes a vibrating member such as a piston in a piston and cylinder combination. The fluid power supply is connected to the vibrating member by a fluid transmission means such as a pipe 5. The vibrating member is in contact with the brush rods and by means of the vibrating member the brush rods are made to move in a desired back and forth motion. The shoe sole cleaner according to the invention is low in construction so that it fits in the place of ordinary doormats. The cleaner can be extended simply by connecting serveral similar brush sections together as a large shoe sole cleaner.

14 Claims, 5 Drawing Sheets

SHOE SOLE CLEANER

FIELD AND BACKGROUND OF THE INVENTION

The present invention relates to a shoe sole cleaner comprising a power section and a brush section which is essentially planelike and which includes brush rods.

In wintertime, as well as in the damp spring and autumn weather, the problem both in private homes and in offices and large public facilities is that snow, sand and other such impurities are carried into the interior along with shoes, irrespective of the shoe cleaning devices placed at the doorstep. It has also been noticed that only a fraction of customers entering for instance shops bother to wipe their shoes to the doormat or the like.

In the prior art, the solving of this problem has been attempted for example by means of the shoe sole cleaning machine introduced in the Finnish Pat. No. 22604. This apparatus is formed of a box-like housing and several shoe brushes that are fitted therein and rotate around their axes. The brushes are connected to an electric motor, and they are switched to operation every time the housing is stepped on. In addition to this, the apparatus comprises a vacuum cleaner, which is switched to operation simultaneously with the brushes. The purpose of the vacuum cleaner is to remove the dirt which is gathered inside the apparatus, so that for instance the brushes would not unnecessarily whip dust into the air.

The apparatus is practicable only in facilities which are originally planned for its use and application. It must be fitted, together with the machinery, into the floor construction, and its outer dimensions are determined according to the specific location where it is used. The dust container of the apparatus is an unnecessary auxiliary device, which unreasonably increases the cost of the whole apparatus— although it cannot suck the litter and sand collected into the box placed under the brushes, but only the finely powdered dust. The aforementioned drawback is caused by the air leakages through the brush intervals, which effectively prevent the creation of sufficient suction.

The Norwegian Pat. No. 96305 also introduces a shoe cleaning machine, where an electric motor rotates a brush belt. The belt cleans the shoes of anyone stepping on the apparatus. Under the apparatus there is arranged either a removable, drainable through or a separate conveyor which carries the sand and litter away. It is apparent that this apparatus is, like the ones above, fitted into the floor construction and thus meant to be installed already at the building stage. Therefore this kind of apparatus is not suited for replacing an ordinary doormat as later installation.

The shoe sole cleaner introduced in the U.S. Pat. No. 3,228,052 is likewise meant to be installed at a recess arranged in the building already at the building stage. In this apparatus, too, the cleaning of shoe soles is carried out by aid of a rotating brush belt. Similar cleaning apparatuses are introduced for instance in the Swedish Pat. No. 48271 and in the U.S. Pat. No. 4,014,060.

A corresponding shoe sole cleaner, but provided with a different brush arrangement, is introduced in the U.S. Pat. No. 4,313,238. In this apparatus, separate brushes sweep to and from by intermediation of a complicated leverage. This apparatus is likewise meant to be installed in a recess.

In the apparatus introduced in the German Pat. No. 482221, the brushes move back and forth for example by means of a crank lever mechanism coupled to an electric motor. In other respects, the apparatus is also designed for installation in a recess.

As it is apparent from the above description of the prior art, there does not exist a previously designed shoe sole cleaner which would be suited for almost all possible facilities as a later installation, but nearly all of the specified apparatuses need a relatively spacious recess which is arranged for instance in the hall floor, into which recess the apparatus can be fitted. However, there exist a noteworthy demand for increasing the general standard of housing and cozy comfort afterwards, which cannot be met by means of the above described arrangements.

SUMMARY OF THE INVENTION

The object of the invention is to replace conventional boot-scrapers, grates and doormats by an apparatus according to the present invention. A typical feature of the operation of the new shoe sole cleaner is that it does the cleaning automatically so that the user does not have to actively scrape his shoes to the aforementioned devices.

The object of the present invention is also to eliminate the above mentioned drawbacks. Thus the conditions set for the apparatus of the present invention were, among others, that it must be installable to already existing facilities, it must be convenient for users, it must be extendable according to specific needs (cf. private houses, libraries, warehouses etc.), it must be economical in purchase price and consequently simple in structure, so that the maintenance, cleaning and removal would be easily carried out.

According to the invention a shoe sole cleaner comprises a power section and a brush section which is essentially planelike and which includes brush rods wherein the power section and the brush section are placed at a distance from each other; the power section is provided with a fluid power supply means; the brush section includes a vibrating member such as a piston in a piston and cylinder combination; the fluid power supply means are connected to the vibrating member by a fluid transmission means such as a pipe; and the vibrating member is in contact with the brush rods and by means of the vibrating member the brush rods are made to move in a desired back and forth motion.

An advantage of the present invention is that it is easily maintained and cleaned. The brush rods of the brush section are easily maintained and cleaned. The brush rods of the brush section are easily removed and replaced. This can be done by first removing the connecting sleeves by drawing them aside with respect to the connecting joint. The joint itself is advantageously made for instance so that the end of one rod is provided with a slot, and the end of the other rod is provided with a corresponding bracket. The cleaning of the apparatus, i.e. the removal of the litter and sand gathered under the cleaner, is carried out either by lifting the brush section to an upright position, or so that under the brush section there is provided a separate low drawer, where the sand etc. is collected. Similarly, if the power section goes out of order it can advantageously be removed and replaced without having to replace the whole cleaner.

Another advantage of the invention is that the apparatuses form a kind of a model series, so that several similar of nearly similar apparatuses can be compiled into a unit larger than one on the basis of the module principale. The apparatus compiled of similar elements can be used both in private homes and in small and large public facilities. Moreover, the module construction of the invention allows for large production series and consequently a low purchase price, wherefore the cost of the apparatus is quickly redeemed in saved labor and reduced floor cleaning expenses.

BRIEF DESCRIPTION OF THE DRAWINGS

The characteristic novel features of the shoe sole cleaner are apparent from the appended patent claims.

In the following the apparatus of the invention and its other advantages are described in detail with reference to the appended drawings, wherein.

DETAILED DESCRIPTION OF THE PREFERRED EMBODIMENTS

Figure 1:
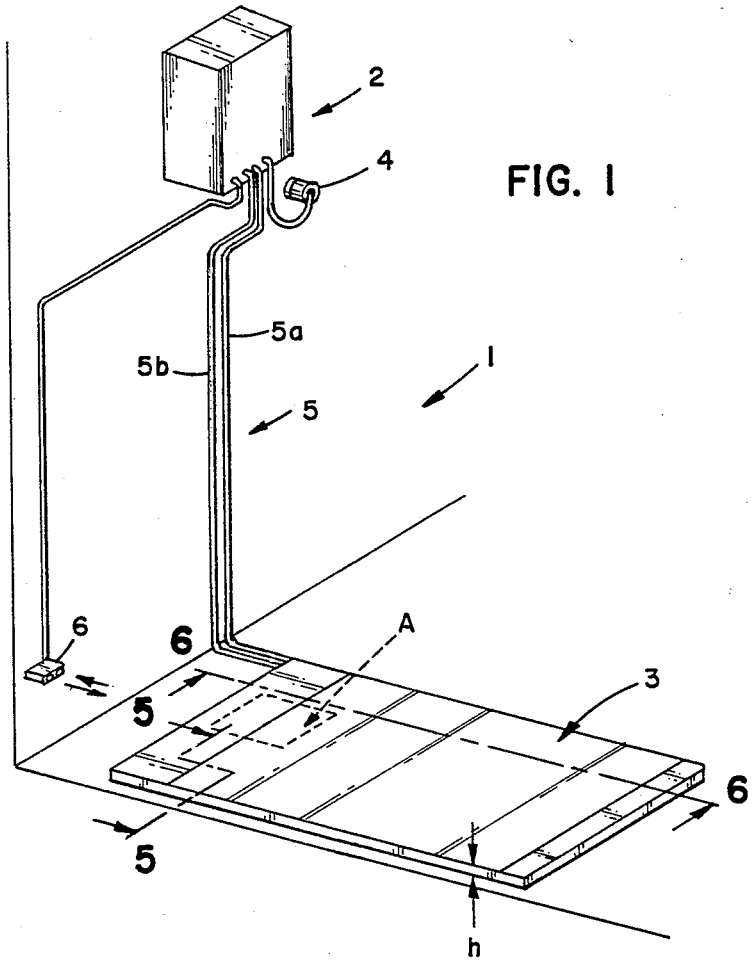
FIG. 1 is a perspective illustration of a shoe sole cleaner.

FIG. 1 illustrates an embodiment for the shoe sole cleaner 1 of the invention. This cleaner comprises a power section 2 and a brush section 3. In this case the power section 2 is fastened to the wall. It contains an electric motor 7 (FIG. 3*a*) which is connected to the electric network by means of the wire 4. The electric motor runs a fluid power supply means 10 (FIG. 2*a* and 2*b*), which is coupled to the brush section 3 by a fluid transmission means such as a pipe 5; 5*a*, 5*b*. The brush section 3 contains a piston and cylinder combination whereby the brush rods 45 (FIG. 6) of the brush section are made to move in a desired back and forth motion.

The brush section 3 is installed to a suitable place near the entrance door. At a suitable height, in between the brush section 3 and the entrance door, there is placed a photocell 6, by means of which the electric motor and the connected brush section 3 are switched to operation when somebody steps in through the door.

The dimensions of the brush section are for instance as follows: length in the longitudinal direction about 800 mm and total width about 1000 mm, so that the apparatus can be fitted into ordinary hallways. A cleaner designed particularly for use in private homes could respectively be of the size 500×800 mm.

The brush section 3 is advantageously low; its height h is for instance roughly 25–30 mm, so that the apparatus fits into the recesses meant for ordinary doormats for instance in shops and other such places. Similarly, in private homes the apparatus is placeable immediately adjacent to the threshold, so that the formation of any inconvenient platform is avoided.

Figure 2A:
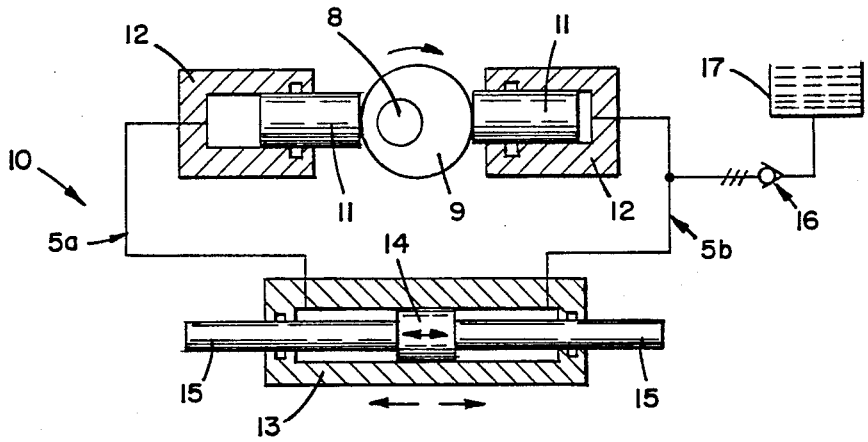
FIG. 2*a* and 2*b* are two schematical illustrations of the structure of the apparatus of FIG. 1.

The principle of construction and operation for the shoe sole cleaner of FIG. 1 is apparent from FIG. 2*a*. A cam 9 located on the axis 8 of the electric motor 7 (FIG. 3*a*) moves the piston or pistons 11 located on the opposite sides of the cam and belonging to the fluid power supply means 10, so that the fluid in the pipes 5 flows, owing to the effect of the two pistons, in turn in opposite directions to the time of the rotating motor. The cylinders 12, wherein the pistons 11 moved by the cam 9 are located, are fastened in a stationary fashion for instance to the housing of the power section and coupled, by intermediation of the pipes 5; 5*a*, 5*b*, to the third cylinder 13, one pipe 5*a* to one side of the piston 14, and second pipe 5*b* to the other side of the same piston 14. The fluid moving back and forth to the time of the rotating motor makes the piston 14 of the third cylinder 13 to move to the same rhythm. As the cylinder 13 is permanently attached to the housing of the brush section, the impetus for the brush rods is obtained from the back and forth vibrating member i.e. piston 14 by intermediation of the piston rods 15.

Figure 2B:
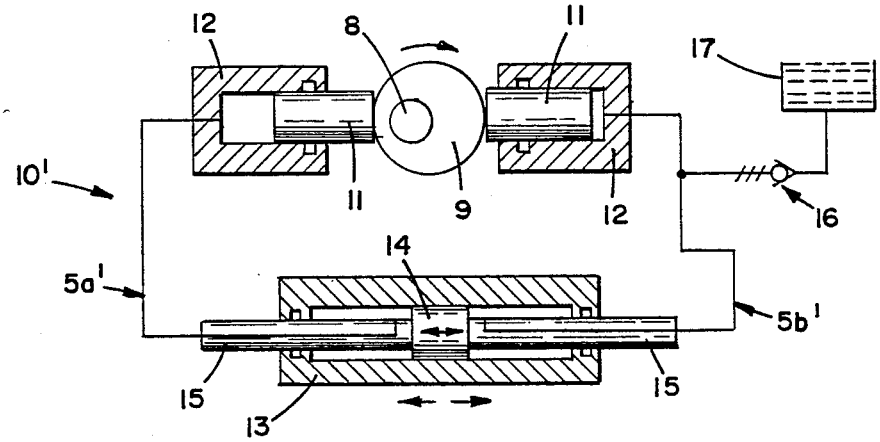

The fluid can be conducted into the cylinder 13 also through the piston rods 15, as you can see in FIG. 2*b*. In this case the piston rods 15 are permanently fastened to the brush section, and the cylinder 13 moves and forms said vibrating member. The impetus for the brush rods is obtained therefrom.

In order to avoid a fluid deficit in the fluid power supply means 10, to either of the fluid pipes 5 there is coupled a countervalve 16, which is connected to the tank 17, wherefrom fresh fluid is automatically fed into the machine via the countervalve 16 if a fluid deficit tends to arise in the pipes or in the cylinder. The piston 14 and the cylinder 13 serving as the vibrating member are not in absolutely tight contact, so as to allow the fluid and the pressure to be balanced throughout the system. This minor leakage is not of essential importance in the operation or efficiency of the fluid power supply means, because the vibration frequency is so high—for instance 10 Hz—that the leakage has not time to affect the motion.

The fluid power supply means 10 of the above described type has the advantage that the power unit, i.e. the power section 2 (the motor and the pistons moved by the cams) can be placed apart from the vibrating members proper, i.e. from the third piston and cylinder combination, even to a distance of several meters, and the vibrating member itself fits into a small, essentially low space in connection with the brush section 3.

Figure 3A:
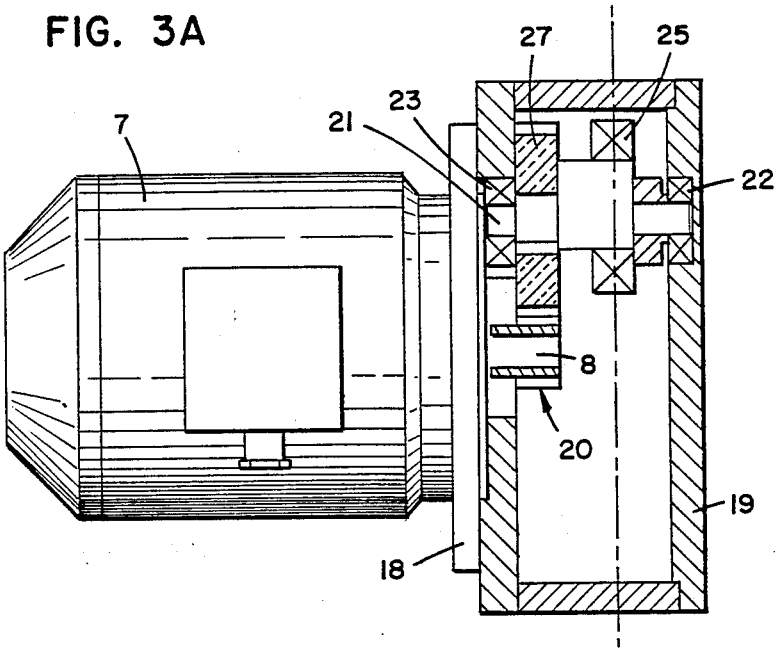
FIGS. 3*a* and 3*b* illustrate a preferred embodiment of a fluid power supply means which is used in the cleaner of FIG. 1, seen in partial longitudinal and transversal cross-section.
Figure 3B:
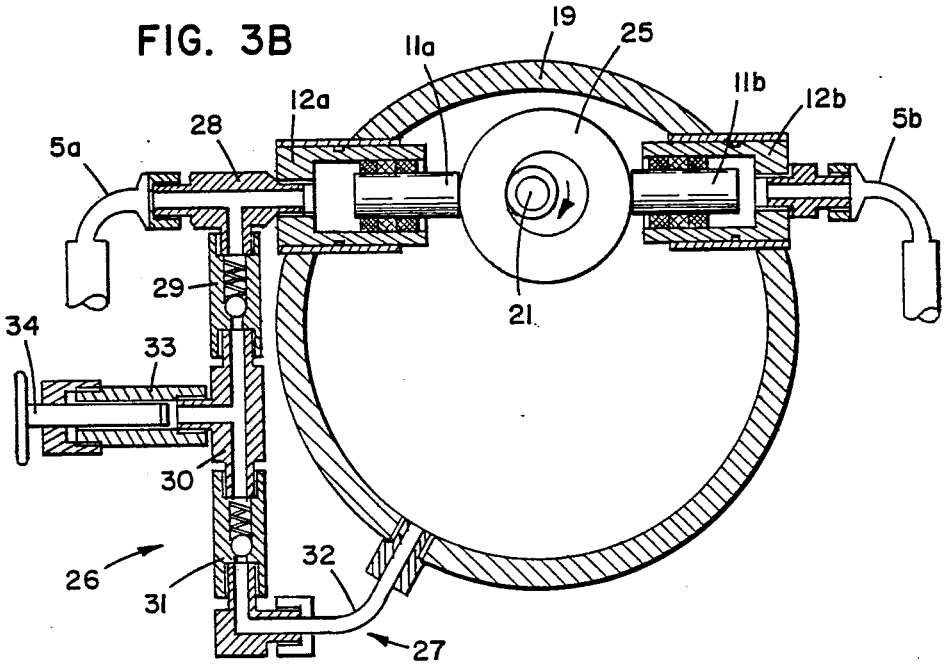

FIGS. 3*a* and 3*b* are detailed illustrations of a preferred embodiment of the power section 2 of the shoe sole cleaner of the invention, as represented in FIG. 1. The electric motor 7 is attached to the oil chamber 19 by aid of the flange 18. The axis of the electric motor 7 is provided with the first cog-wheel 20, and the auxiliary axis 21, which is journalled in between the walls of the oil chamber 19 with bearings 22, 23, is provided with the second cog-wheel 24. By means of the cog-wheels 20, 24, the rotating speed of the motor is adapted to be suitable for the fluid power supply means. In this case the employed cam is a round disc 25, which is eccentrically fastened onto the auxiliary axis 21. It may also be elliptical in shape.

Within the oil chamber 19, there are attached, on the opposite sides of the disc 25, the first and second cylinder 12*a* and 12*b*, whereto the pistons 11*a*, 11*b* are respectively fastened. The piston ends are arranged to conform to the circumference of the disc 25. The cylinder chambers of the cylinders 12*a*, 12*b* are connected to the pipes 5*a*, 5*b* respectively, and the pipes are further connected to the brush sections 3.

One of the pipes 5*a*, 5*b* is advantageously connected both to the feed valve 26 and to the bottom of the oil chamber 19. Through the feed valve 26 the oil pipes 5*a*, 5*b* and the fluid power system are filled with oil. Through the bottom service link 27 of the oil chamber 19 any oil deficit in the system is rapidly made up for by the oil from the oil chamber.

The feed valve 26 and the bottom service link 27 comprise the first connecting T-piece 28, the first back-pressure valve 29, the second connecting T-piece 30, the second back-pressure valve 31 and the service pipe 32 connected to the bottom of the oil chamber 19. To one of the connecting T-pieces there is coupled the cylinder or sleeve 33 and further, by means of threadings, the manually pressed piston pump 34. The pump 34 can be removed and replaced by an oil feed pipe through means of which oil can be fed to the fluid system from a suitable external tank. On the other hand, the system may also be filled from the oil chamber 19 by aid of the piston pump 34, and the oil chamber 19 in turn through a suitable inlet or valve.

In practice the feed valve 26 and the bottom service link 27 are operated as follows. Let us assume that the oil chamber 19 is filled with oil, and that the rest of the fluid power system is completely without oil. The piston pump 34 is now in the internal position according to FIG. 3*b*. When the piston is drawn out to the external position, the pressure within the sleeve 33 and in the connecting T-piece 30 is reduced, so that the valve 31 is opened due to the pressure in the oil chamber 19, and the T-piece 30 and the sleeve 33 are filled with oil. When the piston of the piston pump 34 is now pushed in, to the internal position, the pressure in the T-piece 30 and in the sleeve 33 grows and surpasses the pressure in the pipe 5*a* and in the whole system, so that the valve 29 is opened and the oil flows from the sleeve into the pipe 5*a* and further on. Simultaneously the second valve 31 is closed, and the oil has no access back to the oil chamber 19. By repeating the same procedure with the piston pump 34, the pipes 5*a*5*b* and the connected cylinder chambers are filled with oil, or any possible deficits owing to leakages are made up for by adding oil into the system.

Figure 4:
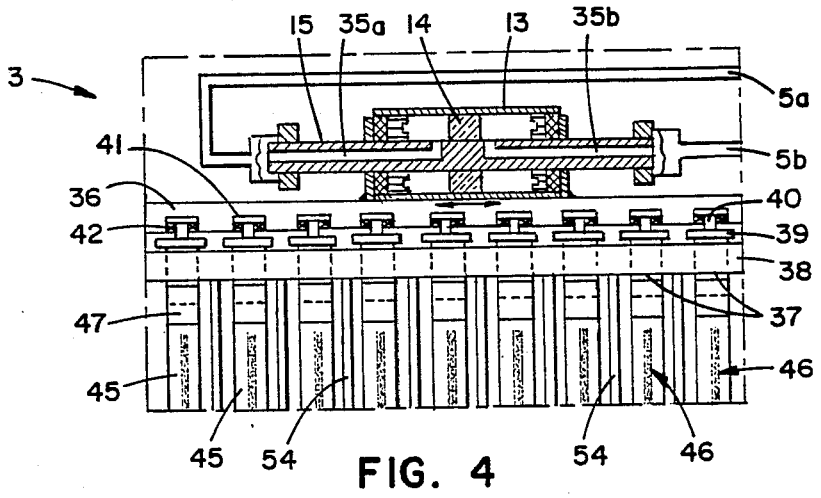
FIG. 4 illustrates the point A in the brush section of the cleaner of FIG. 1.

The pipes 5; 5*a*, 5*b* are connected to the brush section 3 of the cleaner 1, as is apparent from FIG. 1. The brush section 3 is provided with the third cylinder 13 and the third piston 14 of said cylinder, as is schematically illustrated in FIG. 2*a*. FIG. 4 illustrates the point B of the brush section 3 of FIG. 1.

In the preferred embodiment of the invention, the piston 14 and the connected piston rod 15 are in a stationary fashion attached to the housing of the brush section 3. The pipes 5*a*, 5*b* are connected to the channels 35*a*, 35*b* of the piston rod 15 respectively. The first channel 35*a* opens into the cylinder space located on the left-hand side of the piston 14, and the second channel 35*b*opens to the cylinder space located on the right-hand side of the piston 14. The moving cylinder 13 is permanently fastened to the transmission shaft 36, having the same width as the brush section 3, and the brush rods 45 are moved by aid of the said transmission shaft 36.

Figure 6:
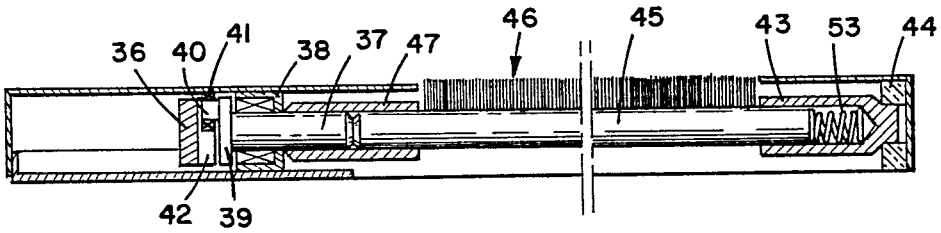
FIG. 6 is a cross-sectional view of the brush section of the cleaner of FIG. 1, seen along the line C—C.
Figure 5:
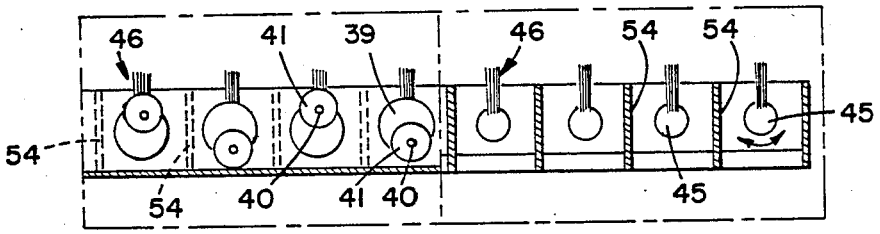
FIG. 5 is a cross-sectional view of the brush section of the cleaner of FIG. 1, seen along the line B—B.

The brush section 3 comprises the brushes 46 fixed to the brush rods 45 as you can see in FIGS. 4, 5 and 6. The grill plates 54 are fitted in between said rods. The brush rods are journalled to the transversal support bar 38 and to the end piece 44.

The transmission shaft 36 is connected to the brush rods 45 for instance in the following fashion presented in FIGS. 4, 5 and 6. The brush rods 45 are connected, by aid of the connecting sleeves 47, to the adapter pieces 37. These are journalled to the transversal support bar 38 of the brush section 3. The end of each adapter piece 37 is advantageously provided with a flange 39 or with an extension, where a pin 40 or similar bracket is placed eccentrically. The pin 40 is advantageously provided with a sensitive rotating roller 41 or bearing, or it can be provided with a suitable sliding surface. The pin 40 with roller 41 is fitted to move along the vertical groove 42 or the like of the transmission shaft 36.

When the transmission shaft 36 vibrates, along with the cylinder 13, from one extreme position to the other, the rollers 41 move vertically along the grooves 42 and circle, due to the eccentric position of the pins 40, around the brush rods 45 by intermediation of the adapter pieces 37, also between the two extreme positions. The vibrating back and forth motion of the transmission shaft 36 may be roughly between 5–10 mm, whereby the brushes 46 and the brush rods 45 are wound 45°–90° around their axes.

In the other end of the brush section 3, opposite to the transmission shaft 36, the brush rods 45 are fitted within the sleeves 43, which are fastened to the end piece 44. Inside the sleeves 43 there are also provided springs 53, which press the brush rods 45 and the adapter pieces 37 against the transmission shaft 36 so that the pins 40 are kept in place in the grooves 42 of the transmission shaft 36.

Figure 7:
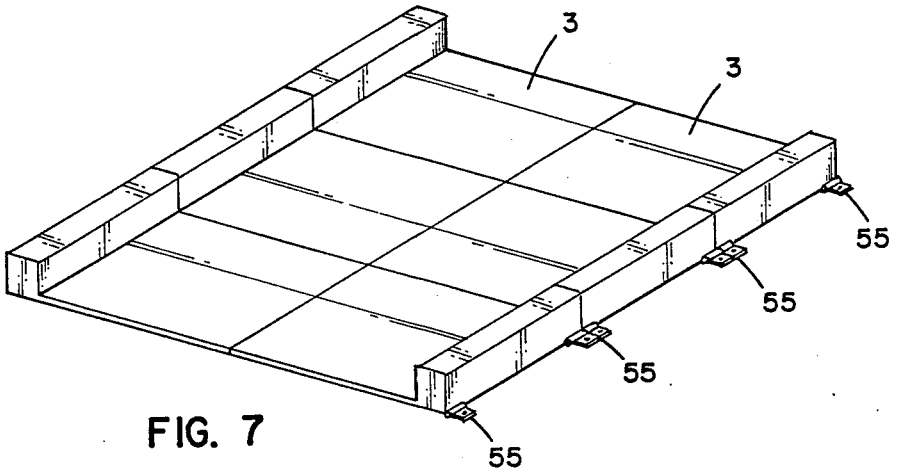
FIG. 7 illustrates a large-size shoe sole cleaner formed of several connected cleaners of the invention.

As seen in FIG. 7, several cleaners of the present invention can be interconnected in order to create large units, for instance to the entrances of warehouses and other such places. FIG. 7 also shows how the apparatuses can be attached to the floor by means of hinges 55. By using hinges, two advantages are gained: thereby the cleaners are kept in place, and the cleaning of the area underneath the cleaners is easily carried out by lifting the cleaners to an upright position supported with the hinges. According to the drawing, it is possible to compile a large cleaner for instance of the size 2400×2000 mm, which is sufficient for even a large crowd of users.

Figure 8:
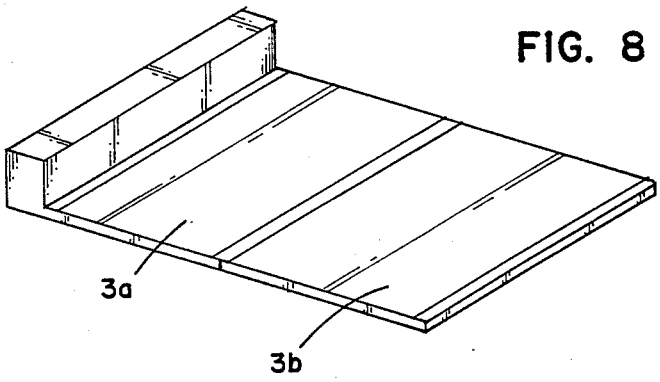
FIG. 8 illustrates a shoe sole cleaner where two brush sections are connected with each other.

As for FIG. 8, there is illustrated another possibility for interconnecting the apparatuses of the invention to the same purpose as in FIG. 7. In this embodiment the brush sections 3*a* and 3*b* are coupled together.

Figure 9:
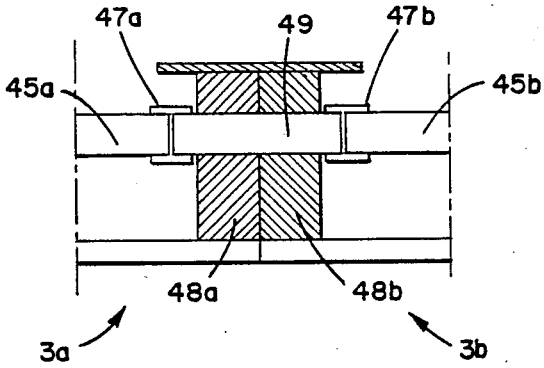
FIG. 9 illustrates a detail of the connecting joint between two separate brush sections.

FIG. 9 illustrates how the brush sections 3*a*, 3*b* of the cleaner are interconnected so that the power transmission from one brush section to another is successively carried out. It is apparent from the figure that the left-hand side brush section 3*a* ends to a side bar 48*a*. The brush rod 45; 45*a*, 45*b* is connected to the axis 49 provided with bearings, by aid of a connecting sleeve 47; 47*a*, 47*b*. The connecting sleeve 47 may be a spring coil, a metal, rubber or plastic sleeve or a similar member. At the edge of the second brush section 3*b*, there is in similar fashion provided a side bar 48*b*, whereto the connecting axis 49 is journalled. The coupling to the brush rod 45*b* is realized in similar fashion as in the left-hand side brush section 3*a*, i.e. by aid of the connecting sleeve 47*b*.

Figure 10:
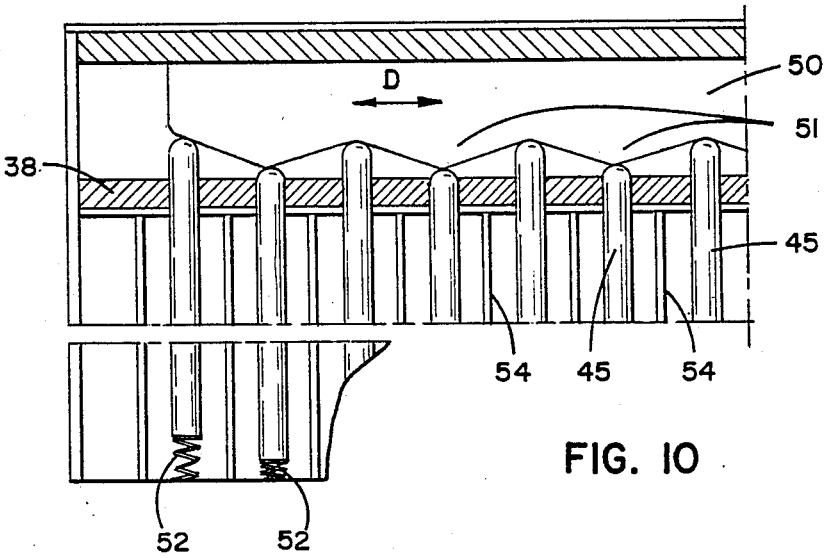
FIG. 10 illustrates another preferred embodiment of the mechanism for moving the brush rods.

FIG. 10 illustrates a preferred embodiment of the invention wherein the brush rods 45 of the brush section are moved axially. In this case there is created by means of the power section a longitudinal back and forth motion D for the cam bar 50. The brush rods 45 conforming to the cams 51 of the cam bar 50 thus assume an axial motion. The back and forth motion of the brush rods 45 is provided for by the springs 52 arranged at the opposite ends of the said rods, which always return the rods, along the surface of the cam bar 50, back to the initial position.

In the above described embodiment of the invention, the motion of the brushes is particularly advantageous. The grooves provided in shoe soles are generally transversal, so that the motion in question cleans the grooves thoroughly and does not gather snow or the like only to the far end of the elongate groove. The length of the working impact required by this task, i.e. the height of the cams 51 of the cam bar 50, may be even below 10 mm. Even 7 mm is sufficient—it has proved to clean the sole to a satisfactory degree provided that the brushes are stiff enough, and that the bristles are short.

It is, however, pointed out that the above specification contains the description of only a few preferred embodiments of the invention, and the purpose is by no means to limit the scope of the invention further than what is suggested in the appended patent claims.

I claim:

1. A shoe sole cleaner, comprising:

(a) a power means including fluid power supply means;

(b) a substantially planar brush means comprising a vibrating member and a plurality of brush rods connected to said vibrating member, said brush means located at a distance from said power means; and (c) fluid transmission means connected to said power means and said vibrating member;

wherein fluid power from said power means is conveyed by said fluid transmission means to said vibrating member, causing said vibrating member to vibrate which causes said brush rods to move in a back and forth motion.

2. A shoe sole cleaner according to claim 1, further comprising a plurality of brush means which are interconnectable in order to form a cleaner of a desired size.

3. A shoe sole cleaner according to claim 2, further comprising connecting means, and wherein said brush rods of each brush means are connected together by said connecting means.

4. A shoe sole cleaner according to claim 1, wherein said brush means is substantially 25mm in height.

5. A shoe sole cleaner according to claim 1, wherein said power means further comprises an electric motor, and wherein said fluid power supply means comprises a cam connected to and rotatably driven by said electric motor, a first piston connected to and driven by said cam, a first cylinder within which said first piston moves thereby generating fluid power, and wherein said first cylinder is connected to said fluid transmission means so as to convey fluid power to said vibrating means, and wherein said vibrating member is driven by a second piston and second cylinder connected to said fluid transmission means.

6. A shoe sole cleaner according to claim 5, further comprising a transmission shaft having vertical slots and being connected to said vibrating member, wherein each of said brush rods comprises a pin disposed eccentrically at a first end of said brush rod and adapted to fit into one of said vertical slots.

7. A shoe sole cleaner according to claim 5, wherein said pin is attached at the end of said brush rod by means of an adapter disposed between and connected to said pin and brush rod.

8. A shoe sole cleaner according to claim 5, further comprising a sleeve and a spring disposed at a second end of said brush rod for pressing said brush rod toward said transmission shaft.

9. A shoe sole cleaner according to claim 5, wherein said fluid power supply means comprises an oil chamber located near said first piston, said first cylinder, and said cam.

10. A shoe sole cleaner according to claim 9, wherein said fluid power supply means comprises a feed valve and said oil chamber a bottom service link which feed valve and bottom service link comprise a first connecting T-piece, the first back-pressure valve, the second connecting T-piece, the second back-pressure valve and the service pipe by means of which fluid can be fed to said fluid power system.

11. A shoe sole cleaner according to claim 10, wherein a cylinder and manually operated piston pump are coupled to said second T-piece.

12. A shoe sole cleaner according to claim 1, wherein said brush means comprises a cam bar having a plurality of cam surfaces and being in contact with said brush rods, whereby said brush rods are caused to move in an axial direction when said cam bar is moved in a transverse direction.

13. A shoe sole cleaner according to claim 12, further comprising spring means disposed at an end of said brush rods opposite said cam bar for pushing said brush rods toward said cam bar.

14. A shoe sole cleaner according to claim 1, further comprising photocell means connected to said power means for activating said power means.

* * * * *